US010801204B2

(12) United States Patent
Chizek

(10) Patent No.: US 10,801,204 B2
(45) Date of Patent: Oct. 13, 2020

(54) STRUCTURAL SUPPORT SYSTEM

(71) Applicant: Thomas Chizek, Saskatoon (CA)

(72) Inventor: Thomas Chizek, Saskatoon (CA)

( * ) Notice: Subject to any disclaimer, the term of this patent is extended or adjusted under 35 U.S.C. 154(b) by 229 days.

(21) Appl. No.: 15/978,157

(22) Filed: May 13, 2018

(65) Prior Publication Data

US 2019/0345716 A1 Nov. 14, 2019

(30) Foreign Application Priority Data

May 11, 2018 (CA) ..... 3004659

(51) Int. Cl.

| | |
|---|---|
| ***E04C 3/11*** | (2006.01) |
| ***E04C 3/29*** | (2006.01) |
| *E04C 3/04* | (2006.01) |
| *E04C 3/02* | (2006.01) |
| *E04B 1/24* | (2006.01) |

(52) U.S. Cl.

CPC ..... *E04C 3/11* (2013.01); *E04C 3/29* (2013.01); *E04B 2001/2415* (2013.01); *E04C 2003/026* (2013.01); *E04C 2003/0452* (2013.01); *E04C 2003/0486* (2013.01)

(58) Field of Classification Search

CPC ..... E04C 3/08; E04C 3/11; E04C 3/29; E04C 2003/0452; E04C 2003/026; E04C 2003/0486; E04C 2003/0491

USPC ..... 52/182–591, 633, 638, 653.1, 654.1, 52/655.1, 690, 692, 693, 691, 650.1

See application file for complete search history.

(56) References Cited

U.S. PATENT DOCUMENTS

| | | | | | |
|---|---|---|---|---|---|
| 1,376,150 | A * | 4/1921 | Miller | E04F 11/181 | 403/230 |
| 1,925,642 | A * | 9/1933 | Meredith | E04F 11/025 | 52/191 |
| 2,021,457 | A * | 11/1935 | MacKenzie | E04F 11/025 | 52/191 |
| 2,136,071 | A * | 11/1938 | Braden | E04C 3/09 | 52/694 |
| 2,514,607 | A * | 7/1950 | McLean | E01D 6/00 | 52/692 |
| 2,532,649 | A * | 12/1950 | Thompson | E04H 3/12 | 52/182 |
| 3,104,454 | A * | 9/1963 | Sparkia | E04C 3/08 | 29/897.31 |
| 3,221,467 | A * | 12/1965 | Henkels | E04C 3/09 | 52/690 |
| 4,583,335 | A | 4/1986 | Morellini | | |
| 4,586,310 | A * | 5/1986 | Baril | E04C 3/08 | 29/525 |
| 4,831,797 | A | 5/1989 | Vladikovic | | |
| 4,875,315 | A * | 10/1989 | Champagne | E04F 11/025 | 52/189 |

(Continued)

*Primary Examiner* — Brian E Glessner
*Assistant Examiner* — Adam G Barlow
(74) *Attorney, Agent, or Firm* — Antoinette M. Tease

(57) ABSTRACT

A structural support system of paired top and bottom rails connected by a plurality of vertically-oriented brackets, for use in construction settings such as truss arrangements and staircases. The rails have elongated slots for receiving and retaining connectors of the brackets. For staircase arrangements, the upper rail further includes an upper elongated slot for receiving step supports, and at least two paired top-bottom rails are positioned laterally for a step to be secured to upper surfaces of the laterally-adjacent step supports. Spacers can be employed in any or all of the slots for providing a desired distance between brackets or step supports.

10 Claims, 8 Drawing Sheets

(56) References Cited

U.S. PATENT DOCUMENTS 5,437,136 A * 8/1995 Triebel ..... E04C 3/08 52/667
5,649,403 A 7/1997 Haisch
D426,316 S 6/2000 Fisher
6,519,908 B1 * 2/2003 Masterson ..... E04C 3/08 52/289
6,574,923 B1 * 6/2003 Johnsson ..... E04H 3/12 297/243
6,763,912 B2 * 7/2004 Robinson ..... E04F 11/025 182/113
6,993,881 B1 * 2/2006 Ruble ..... E04C 3/08 14/13
7,735,294 B2 6/2010 Moody et al.
7,946,084 B2 * 5/2011 Gibson ..... E04F 11/025 52/187
8,141,318 B2 * 3/2012 Dunbar ..... E04C 3/07 52/636
8,851,096 B2 * 10/2014 De Villenfagne De Sorinnes ..... E04H 15/44 135/122
9,376,820 B2 * 6/2016 Greaves ..... E04F 11/1041
2001/0004823 A1 * 6/2001 Cronin ..... E06C 7/187 52/651.01
2005/0081461 A1 * 4/2005 Gibson ..... E04F 11/00 52/188
2005/0097835 A1 * 5/2005 Nishimoto ..... E06C 1/38 52/182
2006/0053732 A1 * 3/2006 Watson ..... E04C 3/09 52/693
2008/0250747 A1 * 10/2008 Johnson ..... E04C 3/16 52/693
2009/0094930 A1 * 4/2009 Schwoerer ..... E04C 3/16 52/693
2010/0126097 A1 * 5/2010 Powers, III ..... E04C 3/08 52/481.1
2011/0277416 A1 11/2011 Dunbar et al.
2013/0000235 A1 * 1/2013 Espinosa ..... E04B 1/26 52/293.3
2014/0165496 A1 * 6/2014 Vanker ..... E04C 3/08 52/693
2019/0177965 A1 * 6/2019 De Almeida Borges ..... E04B 1/40
2019/0338520 A1 * 11/2019 Goh ..... E04C 3/04

* cited by examiner

STRUCTURAL SUPPORT SYSTEM

FIELD OF THE INVENTION

The present invention relates to structural supports for buildings, and more specifically to structural supports for roofs and staircases.

BACKGROUND OF THE INVENTION

It is known in the construction industry to employ various forms of structural supports. For example, truss systems are commonly used to support building roofs. The structural support systems are of varied designs and materials, all selected by the skilled person as appropriate for the specific context.

In the setting of building roof construction, for example, trusses are used to provide structural support for the weight of the overlying roof materials. Such trusses are commonly composed of wood and often built off-site to desired specifications, with material-limited strength and limited flexibility for on-site modification.

In the context of staircase systems, and especially for exterior applications such as deck or walk-out settings, steps are supported by stringers running the length of the staircase. However, it is known in the art that strength and stability of such arrangements may be compromised with increasing staircase length, particularly with walk-out settings.

What is needed, therefore, is a support system that can be adapted to various structural support contexts while providing enhanced strength and stability compared to conventional systems.

SUMMARY OF THE INVENTION

According to a first broad aspect of the present invention, there is provided a structural support system comprising:

a top rail comprising a downwardly disposed opening extending along at least a part of the length of the top rail from an open top rail end;

a bottom rail comprising an upwardly disposed opening extending along at least a part of the length of the bottom rail from an open bottom rail end; and at least one bracket, the at least one bracket comprising:

at least one upwardly directed connector slidably receivable within and along the downwardly disposed opening from the open top rail end, and sized and configured for retention within the downwardly disposed opening; and at least one downwardly directed connector slidably receivable within and along the upwardly disposed opening from the open bottom rail end, and sized and configured for retention within the upwardly disposed opening.

In some exemplary embodiments of the first aspect, the at least one bracket comprises at least two brackets, with the connectors of each of the at least two brackets for inserting in series into each of the downwardly disposed opening and the upwardly disposed opening. Where there are at least two brackets, exemplary systems may further comprise at least one top rail spacer, the at least one top rail spacer configured for retention within the downwardly disposed opening situate between the upwardly directed connectors of two adjacent brackets of the at least two brackets. Exemplary systems may further comprise at least one bottom rail spacer, the at least one bottom rail spacer configured for retention within the upwardly disposed opening situate between the downwardly directed connectors of two adjacent brackets of the at least two brackets.

In some exemplary systems, the top rail further comprises an upwardly disposed opening extending along at least a part of the length of the top rail from an open top rail end, and the bottom rail further comprises a downwardly disposed opening extending along at least a part of the length of the bottom rail from an open bottom rail end.

In other exemplary systems, the downwardly disposed opening comprises a top rail flange, and the at least one upwardly directed connector comprises a notch for mating with the top rail flange, thus retaining the at least one upwardly directed connector within the downwardly disposed opening; and the upwardly disposed opening comprises a bottom rail flange, and the at least one downwardly directed connector comprises a notch for mating with the bottom rail flange, thus retaining the at least one downwardly directed connector within the upwardly disposed opening.

The top rail, the bottom rail, and the at least one bracket are preferably composed of aluminum.

According to a second broad aspect of the present invention, there is provided a staircase stringer system comprising:

a top rail comprising:

a downwardly disposed top rail opening extending along at least a part of the length of the top rail from an open top rail end; and an upwardly disposed top rail opening extending along at least a part of the length of the top rail from the open top rail end;

a bottom rail comprising an upwardly disposed bottom rail opening extending along at least a part of the length of the bottom rail from an open bottom rail end;

at least one bracket, the at least one bracket comprising:

at least one upwardly directed bracket connector slidably receivable within and along the downwardly disposed top rail opening from the open top rail end, and sized and configured for retention within the downwardly disposed top rail opening; and at least one downwardly directed bracket connector slidably receivable within and along the upwardly disposed bottom rail opening from the open bottom rail end, and sized and configured for retention within the upwardly disposed bottom rail opening; and at least one step support configured for supporting a step, the at least one step support comprising at least one downwardly directed step support connector slidably receivable within and along the upwardly disposed top rail opening from the open top rail end, and sized and configured for retention within the upwardly disposed top rail opening.

In some exemplary embodiments of the second aspect, wherein the at least one bracket comprises at least two brackets, the connectors of each of the at least two brackets are for inserting in series into each of the downwardly disposed top rail opening and the upwardly disposed bottom rail opening. Where there are at least two brackets, exemplary systems may further comprise at least one lower top rail spacer, the at least one lower top rail spacer configured for retention within the downwardly disposed top rail opening situate between the upwardly directed bracket connectors of two adjacent brackets of the at least two brackets. Exemplary systems may further comprise at least one bottom rail spacer, the at least one bottom rail spacer configured for retention within the upwardly disposed bottom rail opening situate between the downwardly directed bracket connectors of two adjacent brackets of the at least two brackets.

In some exemplary embodiments, the at least one step support comprises at least two step supports, the system further comprising at least one upper top rail spacer, the at least one upper top rail spacer configured for retention within the upwardly disposed top rail opening situate between the downwardly directed step support connectors of two adjacent step supports of the at least two step supports.

According to a third broad aspect of the present invention, there is provided a staircase assembly comprising:

two top rails, each of the top rails comprising:

a downwardly disposed top rail opening extending along at least a part of the length of the top rail from an open top rail end; and an upwardly disposed top rail opening extending along at least a part of the length of the top rail from the open top rail end;

two bottom rails, each of the bottom rails comprising an upwardly disposed bottom rail opening extending along at least a part of the length of the bottom rail from an open bottom rail end;

at least two brackets, each of the at least two brackets for connecting one of the two top rails to one of the two bottom rails to form paired top-bottom rail assemblies, the at least one bracket comprising:

at least one upwardly directed bracket connector slidably received within and along the downwardly disposed top rail opening from the open top rail end, and retained within the downwardly disposed top rail opening; and at least one downwardly directed bracket connector slidably received within and along the upwardly disposed bottom rail opening from the open bottom rail end, and retained within the upwardly disposed bottom rail opening;

at least two step supports configured for supporting a step, each of the at least two step supports comprising at least one downwardly directed step support connector slidably received within and along the upwardly disposed top rail opening from the open top rail end, and retained within the upwardly disposed top rail opening; and at least one step for securing to upper surfaces of the at least two step supports.

In some exemplary embodiments of the third aspect, the connectors of each of the at least two brackets are inserted in series into each of the downwardly disposed top rail opening and the upwardly disposed bottom rail opening. In some exemplary assemblies further comprising at least one lower top rail spacer, the at least one lower top rail spacer is retained within the downwardly disposed top rail opening situate between the upwardly directed bracket connectors of two adjacent brackets of the at least two brackets.

In some exemplary assemblies further comprising at least one bottom rail spacer, the at least one bottom rail spacer is retained within the upwardly disposed bottom rail opening situate between the downwardly directed bracket connectors of two adjacent brackets of the at least two brackets.

In some exemplary assemblies further comprising at least one upper top rail spacer, the at least one upper top rail spacer is configured for retention within the upwardly disposed top rail opening situate between the downwardly directed step support connectors of two adjacent step supports of the at least two step supports.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the invention to the precise form of any exemplary embodiment. Accordingly, the description and drawings are to be regarded in an illustrative, rather than a restrictive, sense.

Figure 1:
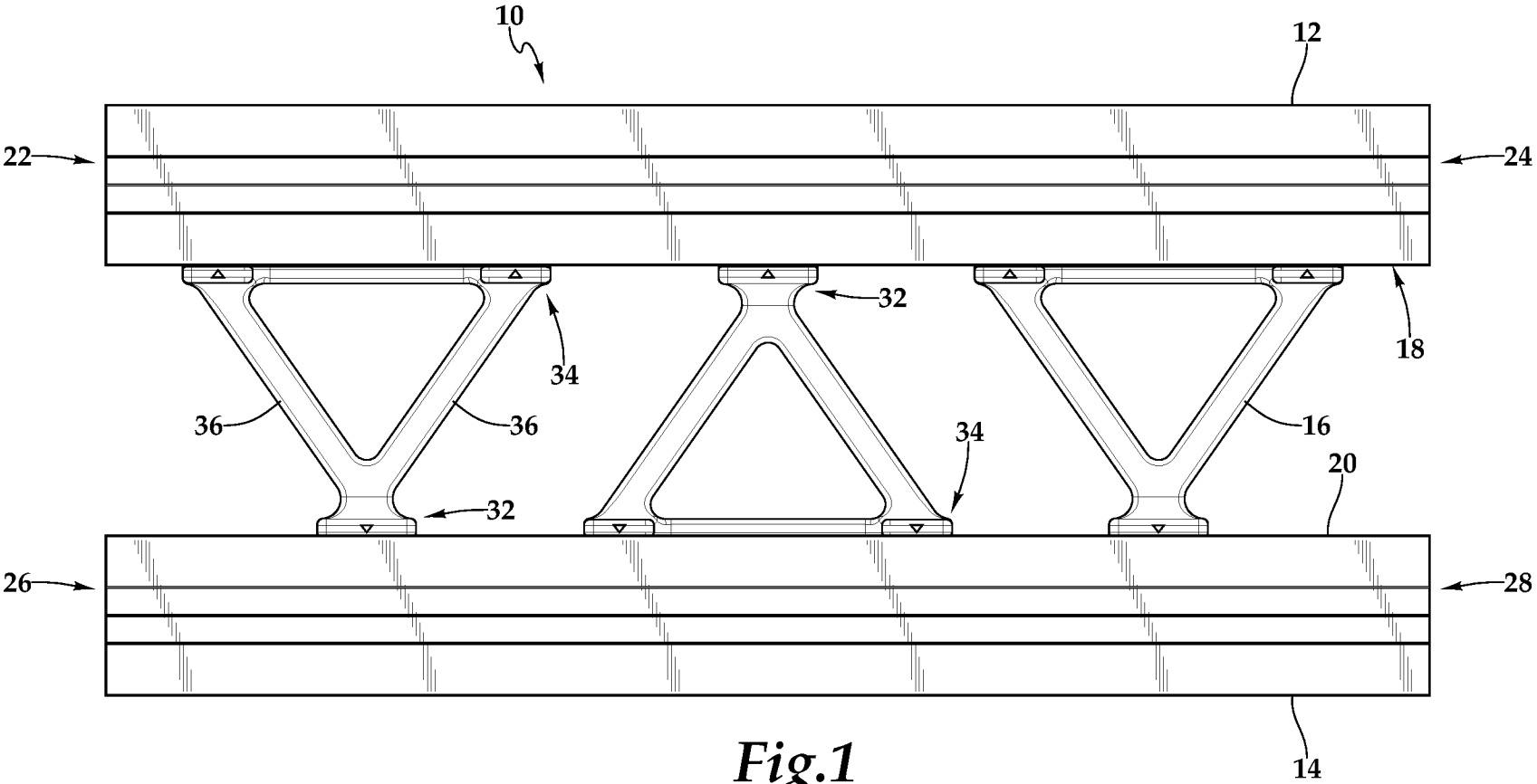
FIG. 1 is a side perspective view of an embodiment of paired top and bottom rails connected by brackets.
Figure 2A:
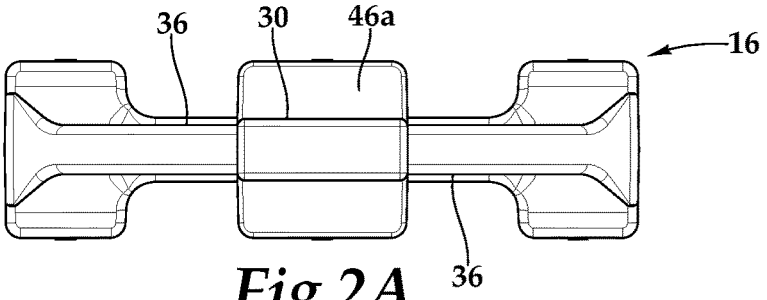
FIGS. 2*a* to 2*d* are bottom plan, side elevation, perspective and front elevation views of an exemplary bracket.
Figure 2B:
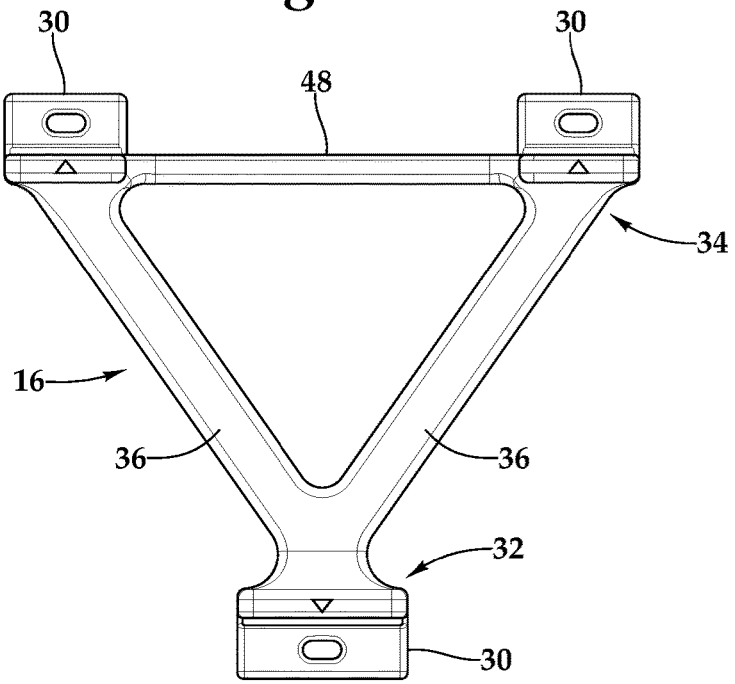
Figure 2D:
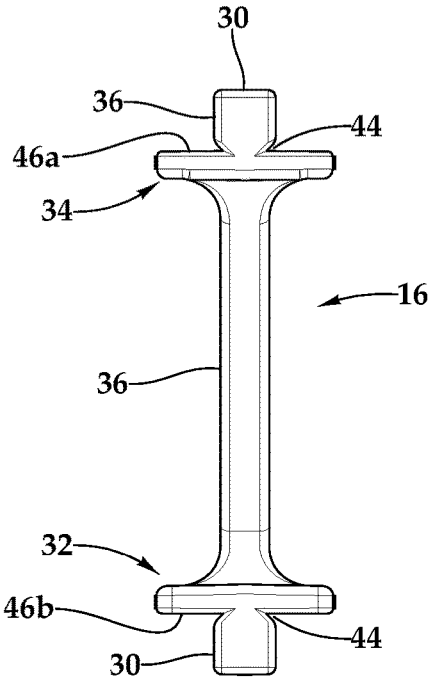
Figure 2C:
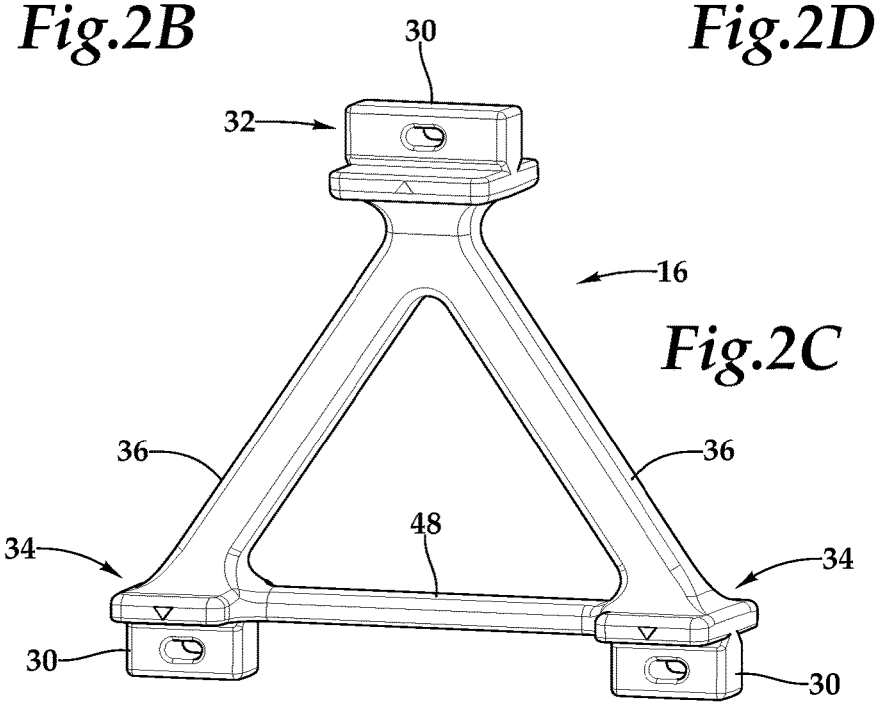

Turning to FIG. 1, an exemplary support 10 is illustrated. The support 10 comprises a top rail 12 and a bottom rail 14, with the rail pair 12, 14 connected by a series of brackets 16. As can be seen, the brackets 16 are oriented in an alternating arrangement, although the brackets 16 could also be oriented all in the same direction (as shown, for example, in FIG. 8*a*). The top rail 12 is of hollow construction and aluminum material in this exemplary embodiment, with a downwardly disposed slot or opening 18 extending the entire length of the top rail 12 between a first open end 22 and a second open end 24. By having this slot 18 open at both ends 22, 24, brackets 16 and spacers 40 (described below) can be inserted into the slot 18 and slid along the slot 18 to be positioned at a desired location along the top rail 12. The bottom rail 14 is also of hollow construction and aluminum material in this exemplary embodiment, with an upwardly disposed slot or opening 20 extending the entire length of the bottom rail 14 between a first open end 26 and a second open end 28, again to allow the brackets 16 and spacers 40 to be slid into a desired position.

With further reference to FIGS. 2*a* to 2*d*, details of the exemplary bracket 16 are illustrated. Each bracket 16 comprises three connectors 30, one at a single-connector side 32 and two at a double-connector side 34, forming a generally triangular component of the support 10. The single-connector side 32 is connected to the double-connector side 34 by means of bracket arms 36, while the two connectors 30 of the double-connector side 34 are connected by means of a connection arm 48. As can best be seen in FIG. 2*d*, each connector 30 comprises a notch or recess 44—this notch 44 is configured to mate with a slot or opening, as will be described further below. When received within a slot or opening, the connectors 30 further comprise contact surfaces 46*a,b* for contact with the rail surface adjacent the slot or opening. The connection arm 48 provides further surface contact with the rail into which the bracket 16 is inserted.

Figure 3B:
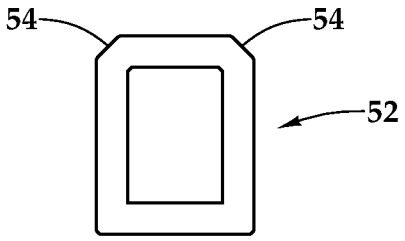
FIG. 3*b* is an end view of an exemplary spacer for insertion in the upper slot shown in FIG. 3*a;*
Figure 3C:
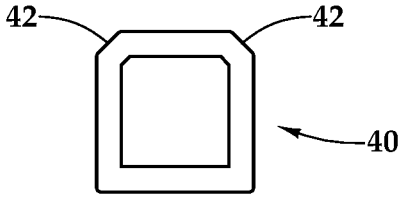
FIG. 3*c* is an end view of an exemplary spacer for insertion in the lower slot shown in FIG. 3*a;*
Figure 3A:
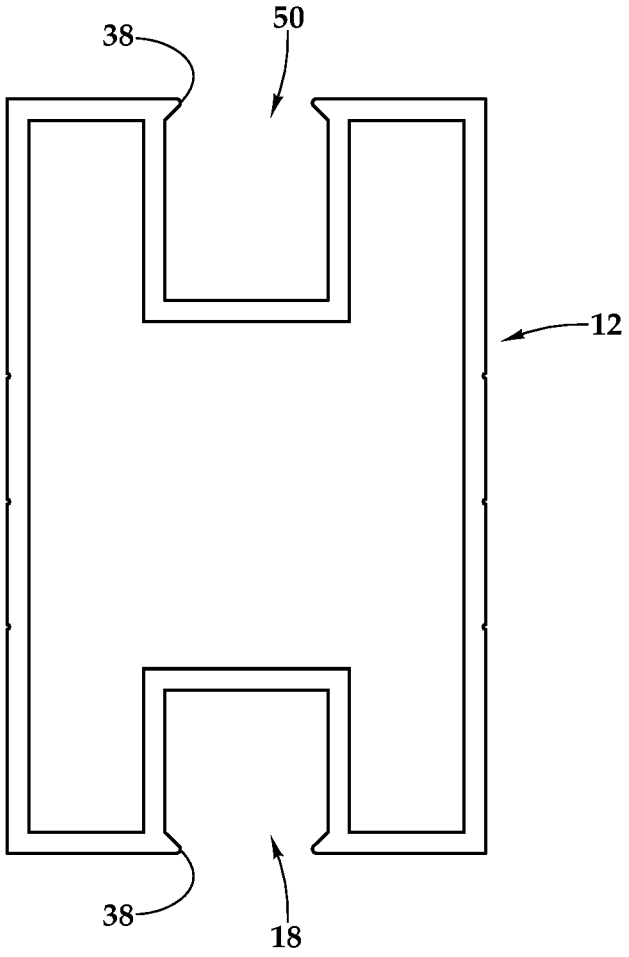
FIG. 3*a* is an end view of an exemplary top rail, showing different depths of slots/openings.
Figure 4D:
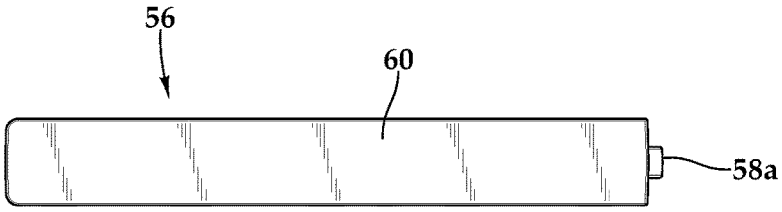
FIGS. 4*a* to 4*e* are front elevation, side elevation, rear elevation, top plan and perspective views of an exemplary step support.
Figure 4A:
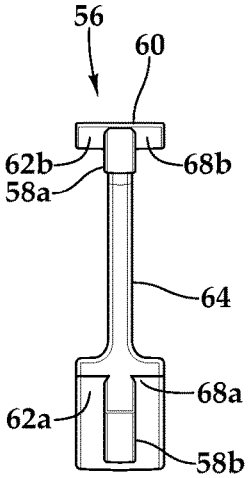
Figure 4B:
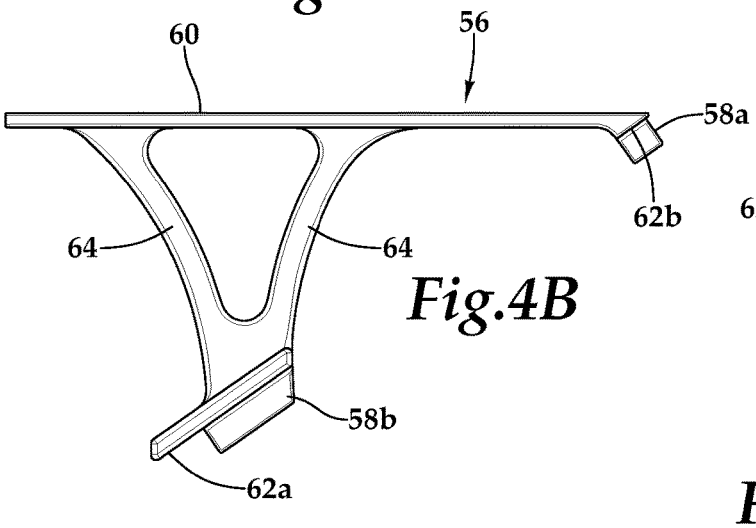
Figure 4C:
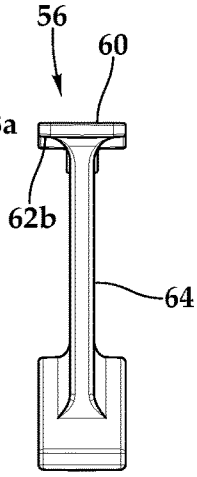
Figure 4E:
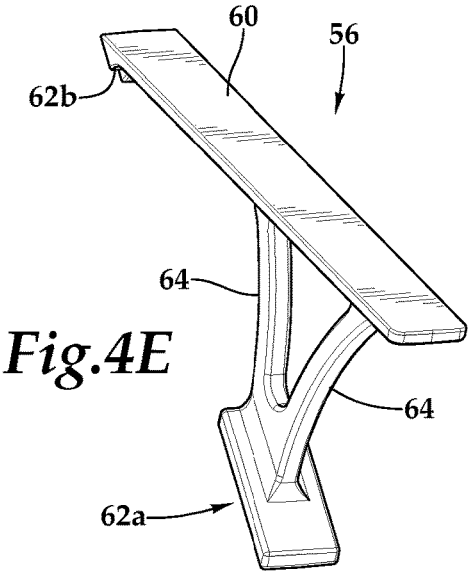

FIG. 3*a* illustrates an exemplary top rail 12, comprising two slots 18 and 50 differing in depth. As indicated above, the top rail 12 is of hollow construction, as can be seen from this end view. The connectors 30 of brackets 16 are configured to be inserted within the downwardly-disposed slot 18. The slot 18 comprises a flange 38, which slightly reduces the width of the slot 18 but provides a mating means for connection to the connectors 30. As stated above, the connectors 30 comprise notches 44. Upon insertion of the connector 30 into the slot 18, the notches 44 mate with the flanges 38, the flanges 38 thus retaining the connector 30 within the slot 18 as the bracket 16 is slid along the slot 18 to a desired location. The upwardly-disposed slot 50 and corresponding spacer 52 are directed to the staircase embodiment, described below.

FIG. 3*c* illustrates a spacer 40 from an end view perspective. Again, this component is of hollow construction and composed of aluminum. The spacer 40 comprises beveled edges 42, which are configured to align with the flanges 38 of the slot 18. As mentioned above, spacers 40 are sized and configured for insertion into and retention within the slot 18, for separating the brackets 16 as desirable. A single spacer 40 would be employed between two adjacent brackets 16, or multiple spacers 40 could separate a single pair of brackets 16. Whereas the notches 44 of the bracket connectors 30 are intended to engage the flanges 38 to retain the brackets 16 in place, the spacers 40 are intended to be positioned entirely within the slot 18 and retained by means of the interface between the beveled edges 42 and the flanges 38.

As can now be seen, the illustrated support 10 can provide a structural support means that is stronger and more stable than a single rail. For example, a support 10 of suitable length and material could be used in a roof truss system for supporting roof overlay, and can be assembled or modified onsite given the materials and the modular nature of the support 10.

Turning now to FIGS. 3*a*, 3*b*, and 4*a* to 8*c*, a further embodiment of the present invention is illustrated, specifically an embodiment directed to using the present invention as part of a staircase arrangement.

As noted above with respect to FIG. 3*a*, the top rail 12 can be provided with an upwardly-disposed slot or opening 50. The slot 50 is sized and configured to receive connectors 58*a,b* of step supports 56, in a manner similar to the bracket connectors 30 as described above. FIGS. 4*a* to 4*e* provide a detailed illustration of such a step support 56, which step supports 56 are intended to provide a foundation for mounting steps thereto at the support surface 60. Each step support 56 comprises a connector 58*a* and a spaced-apart connector 58*b*, the connector 58*b* mounted at the intersection of two step support arms 64. The connectors 58*a,b* are provided with contact surfaces 62*a,b* for contacting the top rail 12 when the connectors 58*a,b* are inserted into the slot 50 and slid therealong into the desired position.

Figure 5A:
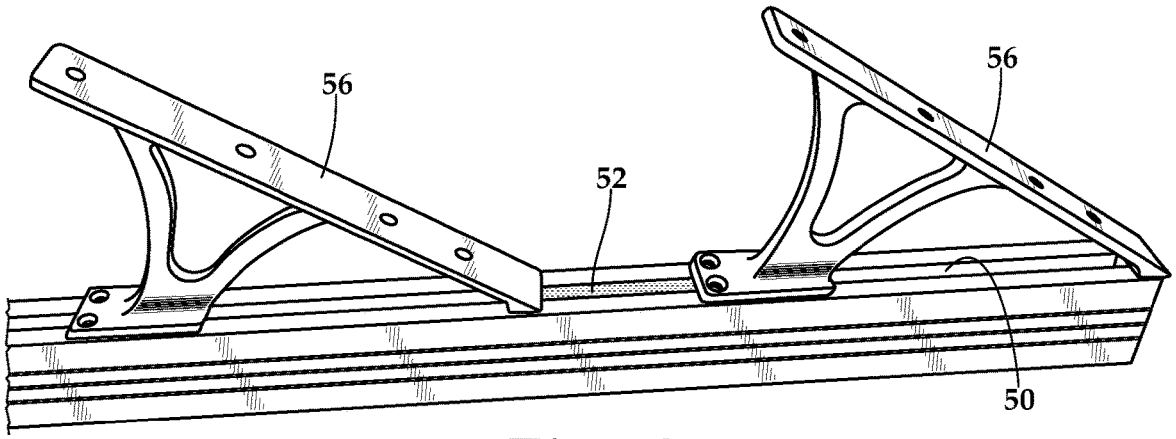
FIGS. 5*a* and 5*b* are top perspective views of step supports and spacers inserted into an exemplary top rail.
Figure 5B:
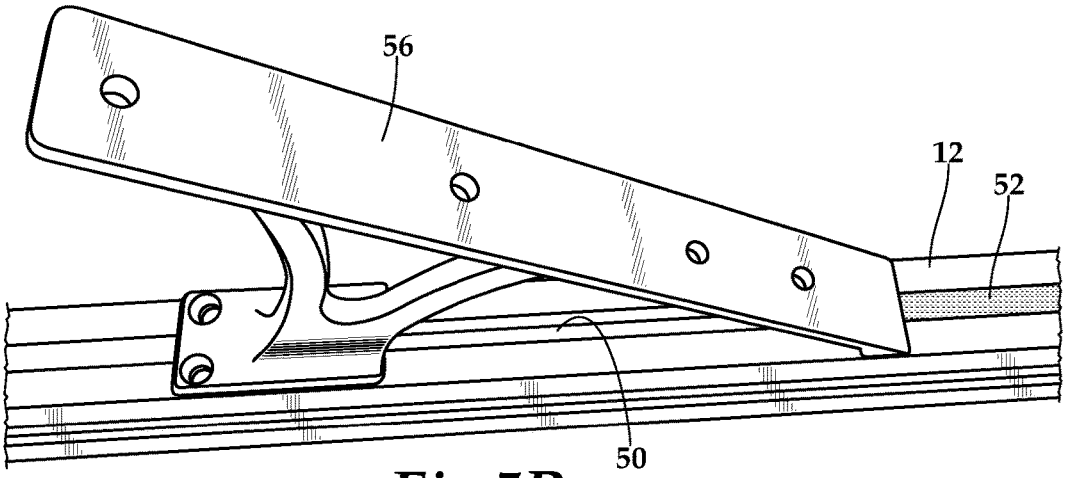
Figure 6:
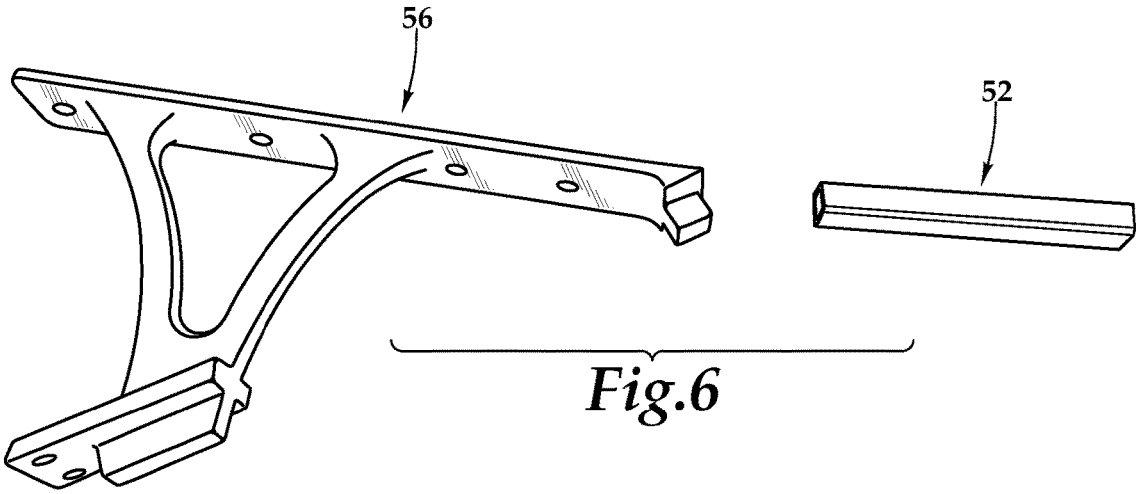
FIG. 6 is a bottom perspective view of a step support and spacer.

The connectors 58*a,b* are again provided with notches/recesses 68*a,b* sized and configured for mating with flanges 38 of the slot 50, to enable the step support 56 to be retained thereby. Further, spacers 52 (as illustrated in FIG. 3*b*) can be positioned between adjacent step supports 56, in any desired and appropriate number, the spacers 52 provided with beveled edges 54 to contact the flanges 38 and thus be retained within the slot 50. FIGS. 5*a* and 5*b* show an example of two step supports 56 separated by a spacer 52 housed within a slot 50. FIG. 6 illustrates an exemplary step support 56 and spacer 52.

Figure 7A:
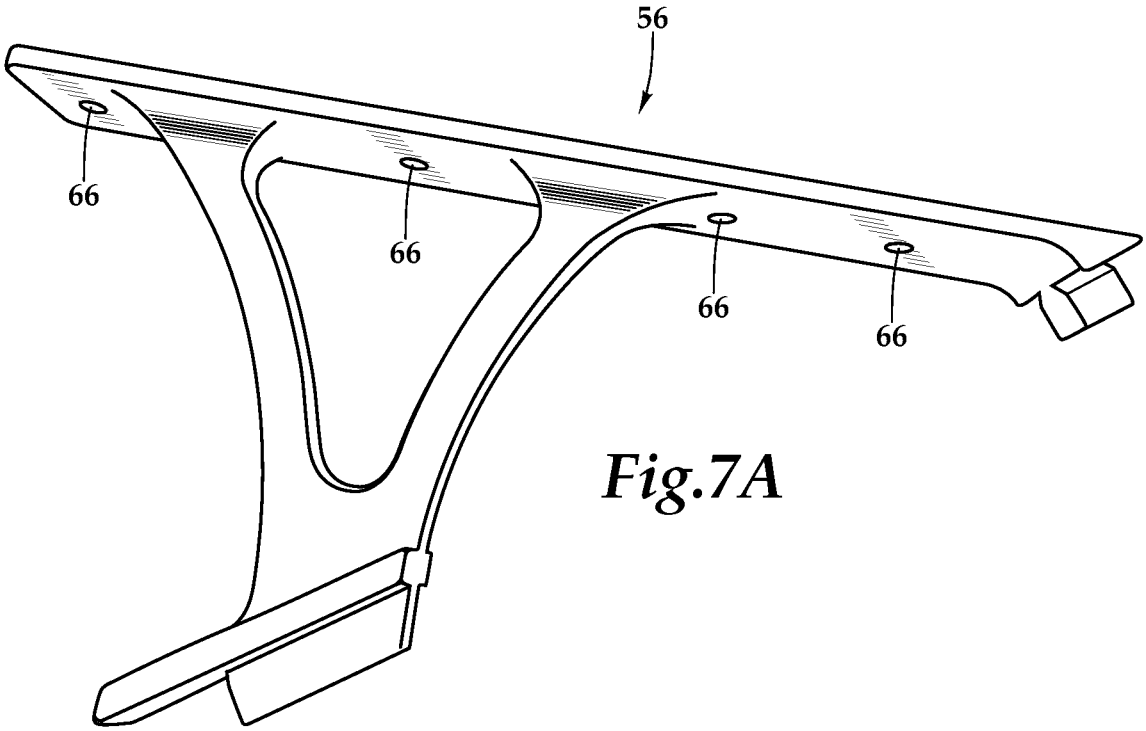
FIGS. 7*a* and 7*b* are side and top perspective views of a step support showing mounting holes for an overlying step.
Figure 7B:
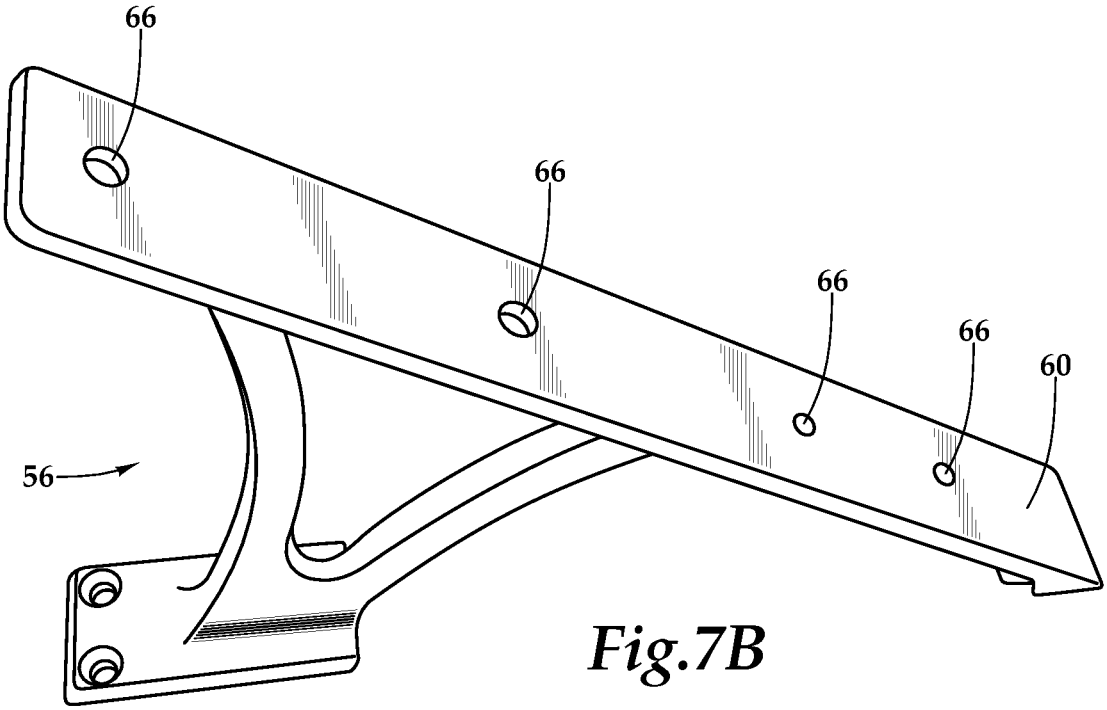

As indicated above, the intention is that steps would be mounted upon or affixed to the support surface 60 of the step support 56. In use, there would be two or more laterally spaced-apart step supports 56 on two or more laterally spaced-apart staircase stringers. The steps can be mounted by any appropriate means known to the skilled person, but in one exemplary embodiment provided for illustrative purposes only the connection can be by screws passing through mounting holes 66, as shown in FIGS. 7*a* and 7*b*.

Figure 8A:
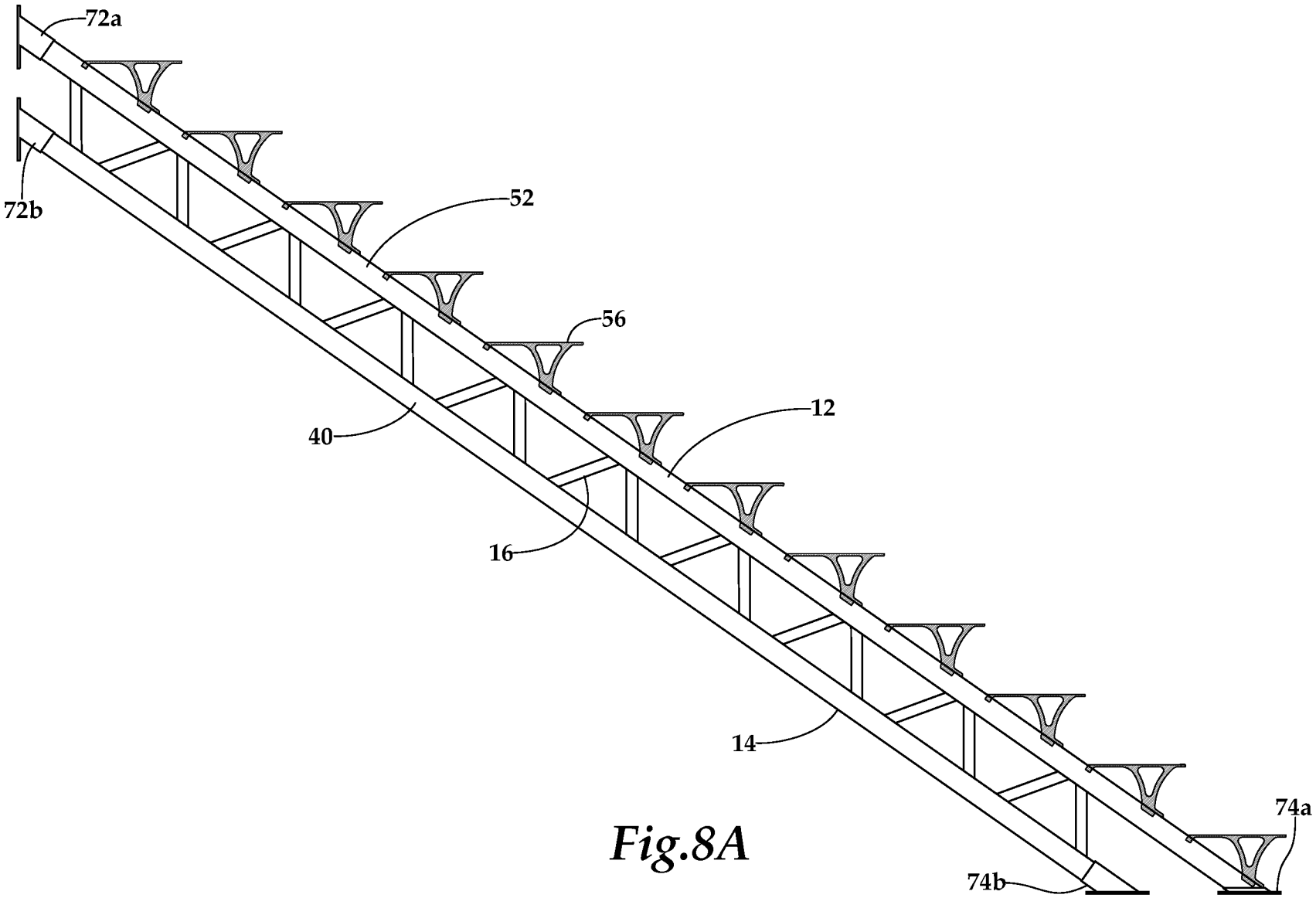
FIGS. 8*a* to 8*c* are side elevation and detail views of a single stringer of an exemplary assembled staircase embodiment according to the present invention.
Figure 8B:
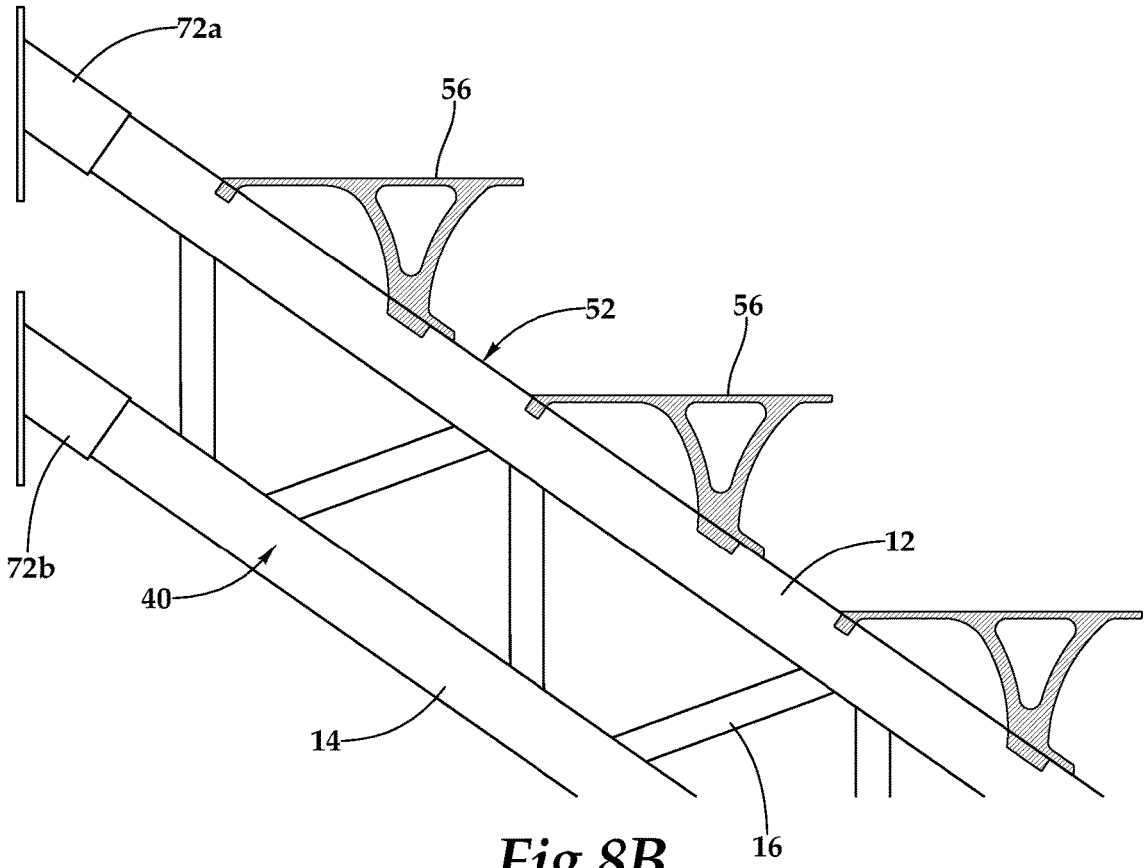
Figure 8C:
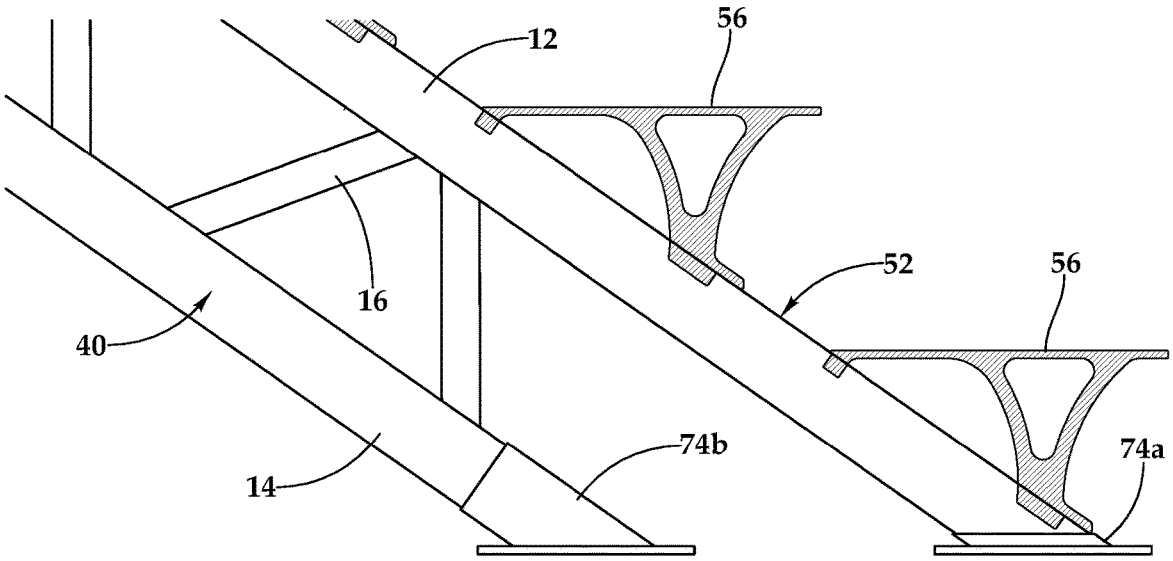

FIGS. 8*a* to 8*c* illustrate an exemplary staircase stringer 70 according to the present invention and the above teaching. The stringer 70 comprises paired top and bottom rails 12, 14, connected by brackets 16 separated by spacers 40. The top rail 12 is further provided with step supports 56, separated by spacers 52. As can be seen, the arrangement allows for a series of step supports 56 extending along the length of the stringer 70 for attachment of steps in a conventional manner. To secure the stringer 70 in place, and to retain the brackets 16, step supports 56 and spacers 40, 52 in place, the first open ends 22, 24 are provided with top caps 72*a,b*, and the second open ends 24, 28 are provided with foot caps 74*a,b*. The caps 72*a,b* and 74*a,b* may be of conventional construction and materials, and would be affixed to supporting surfaces by conventional means well-known to the skilled person.

It will be clear, based on the foregoing, that embodiments of the present invention may have various advantages over conventional arrangements and techniques. In addition to the construction flexibility enabled by the modularity of the present invention, the use of paired top and bottom rails with strengthening brackets therebetween may provide a stronger and more stable support structure. In the case of staircase assemblies, it is possible to have longer stringers without the need for vertical support members than some conventional stringer designs.

While aluminum has been described herein as a desirable exemplary material, the skilled person will be aware of many other materials that could be used in other embodiments of the present invention.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. A staircase stringer system comprising:

a top rail comprising:

a downwardly disposed top rail opening extending along at least a part of the length of the top rail from an open top rail end; and an upwardly disposed top rail opening extending along at least a part of the length of the top rail from the open top rail end;

a bottom rail comprising an upwardly disposed bottom rail opening extending along at least a part of the length of the bottom rail from an open bottom rail end;

at least one bracket, the at least one bracket comprising:

at least one upwardly directed bracket connector slidably receivable within and along the downwardly disposed top rail opening from the open top rail end, and sized and configured for retention within the downwardly disposed top rail opening; and at least one downwardly directed bracket connector slidably receivable within and along the upwardly disposed bottom rail opening from the open bottom rail end, and sized and configured for retention within the upwardly disposed bottom rail opening; and at least one step support configured for supporting a step, the at least one step support comprising at least one downwardly directed step support connector slidably receivable within and along the upwardly disposed top rail opening from the open top rail end, and sized and configured for retention within the upwardly disposed top rail opening.

2. The system of claim 1 wherein the at least one bracket comprises at least two brackets, the connectors of each of the at least two brackets for inserting in series into each of the downwardly disposed top rail opening and the upwardly disposed bottom rail opening.

3. The system of claim 2 further comprising at least one lower top rail spacer, the at least one lower top rail spacer configured for retention within the downwardly disposed top rail opening situate between the upwardly directed bracket connectors of two adjacent brackets of the at least two brackets.

4. The system of claim 2 further comprising at least one bottom rail spacer, the at least one bottom rail spacer configured for retention within the upwardly disposed bottom rail opening situate between the downwardly directed bracket connectors of two adjacent brackets of the at least two brackets.

5. The system of claim 2 wherein the at least one step support comprises at least two step supports, the system further comprising at least one upper top rail spacer, the at least one upper top rail spacer configured for retention within the upwardly disposed top rail opening situate between the downwardly directed step support connectors of two adjacent step supports of the at least two step supports.

6. A staircase assembly comprising:

two top rails, each of the top rails comprising:

a downwardly disposed top rail opening extending along at least a part of the length of the top rail from an open top rail end; and an upwardly disposed top rail opening extending along at least a part of the length of the top rail from the open top rail end;

two bottom rails, each of the bottom rails comprising an upwardly disposed bottom rail opening extending along at least a part of the length of the bottom rail from an open bottom rail end;

at least two brackets, each of the at least two brackets for connecting one of the two top rails to one of the two bottom rails to form paired top-bottom rail assemblies, the at least one bracket comprising:

at least one upwardly directed bracket connector slidably received within and along the downwardly disposed top rail opening from the open top rail end, and retained within the downwardly disposed top rail opening; and at least one downwardly directed bracket connector slidably received within and along the upwardly disposed bottom rail opening from the open bottom rail end, and retained within the upwardly disposed bottom rail opening;

at least two step supports configured for supporting a step, each of the at least two step supports comprising at least one downwardly directed step support connector slidably received within and along the upwardly disposed top rail opening from the open top rail end, and retained within the upwardly disposed top rail opening; and at least one step for securing to upper surfaces of the at least two step supports.

7. The assembly of claim 6 wherein the connectors of each of the at least two brackets are inserted in series into each of the downwardly disposed top rail opening and the upwardly disposed bottom rail opening.

8. The assembly of claim 7 further comprising at least one lower top rail spacer, the at least one lower top rail spacer retained within the downwardly disposed top rail opening situate between the upwardly directed bracket connectors of two adjacent brackets of the at least two brackets.

9. The assembly of claim 7 further comprising at least one bottom rail spacer, the at least one bottom rail spacer retained within the upwardly disposed bottom rail opening situate between the downwardly directed bracket connectors of two adjacent brackets of the at least two brackets.

10. The assembly of claim 7 further comprising at least one upper top rail spacer, the at least one upper top rail spacer configured for retention within the upwardly disposed top rail opening situate between the downwardly directed step support connectors of two adjacent step supports of the at least two step supports.

* * * * *